United States Patent [19]

Daetwyler

[11] Patent Number: 4,651,441

[45] Date of Patent: Mar. 24, 1987

[54] DRYING OVEN INCLUDING SHUTTLE TRANSPORTING MEANS

[75] Inventor: Jürg Daetwyler, Benglen, Switzerland

[73] Assignee: Mettler Instrumente Ag, Greifensee, Switzerland

[21] Appl. No.: 846,749

[22] Filed: Apr. 1, 1986

[51] Int. Cl.[4] ..... F26B 15/04

[52] U.S. Cl. ..... 34/202; 34/236; 118/727; 118/729; 432/5; 432/253

[58] Field of Search ..... 422/78, 80; 118/50, 118/727, 729; 432/5, 6, 253, 152; 34/236, 202

[56] References Cited

U.S. PATENT DOCUMENTS

| | | | |
|---|---|---|---|
| 2,610,107 | 9/1952 | Dreher | 422/78 |
| 4,351,805 | 9/1985 | Reisman et al. | 432/253 |
| 4,412,771 | 11/1983 | Gerlach et al. | 118/729 |

*Primary Examiner*—Schwartz, Larry I.
*Attorney, Agent, or Firm*—Laubscher & Laubscher

[57] ABSTRACT

A drying oven is disclosed including apparatus for transporting a shuttle (51) longitudinally in a drying conduit (5) arranged within an oven, characterized in that the transporting apparatus is at least partially contained within a housing (15) that hermetically seals one end of the drying conduit. The transporting apparatus includes a steel band (27) that is wound at one end of a disk (39) mounted for rotation within the housing, the other end of the band being releasably coupled with the shuttle by a pivotable latch (25).

15 Claims, 5 Drawing Figures

DRYING OVEN INCLUDING SHUTTLE TRANSPORTING MEANS

BRIEF DESCRIPTION OF THE PRIOR ART

This invention relates to a drying oven as used, for example, in analytical laboratory practice.

In drying ovens including a drying conduit, the substance to be dried is inserted within a longitudinal open-topped container called a shuttle which is inserted from one end into the drying conduit. Then the drying conduit must be closed in a hermetically sealed manner during the drying process.

A charging or transporting device for such a drying oven is already known, wherein a thin rod provided with a hook at one end is guided through the housing which closes one end of the drying conduit, the housing being threadably connected with the drying conduit, whereby the shuttle—after it has been introduced into the drying pipe—can be displaced therein. This known device requires very great skill on the part of the operator in grasping and suspending the shuttle from the hook on the rod. Furthermore, this arrangement has the drawback that when the shuttle is retracted, the rod, which has a length of about 30–50 cm, essentially protrudes out of the drying oven over its entire length and interferes with work in the vicinity of the oven.

The present invention was developed to avoid the above and other drawbacks of the known drying oven shuttle transporting devices.

SUMMARY OF THE INVENTION

Accordingly, a primary object of the present invention is to provide an improved drying oven for materials contained in a shuttle arranged within a drying conduit that extends within the oven, including shuttle transport means arranged at least partially within a housing that hermetically seals one end of the drying conduit, and means arranged outside the housing for operating the transport means.

It is now possible to shift the shuttle inside the drying conduit merely by turning a knob and without the protrusion of a rod that interferes with work in the vicinity of the drying oven. Furthermore, according to another feature of the invention, the shuttle is connected automatically the moment the drying conduit has been closed off by the housing.

BRIEF DESCRIPTION OF THE DRAWING

Other objects and advantages of the invention will become apparent from a study of the following specification, when viewed in the light of the accompanying drawing, in which.

DETAILED DESCRIPTION

Figure 1:
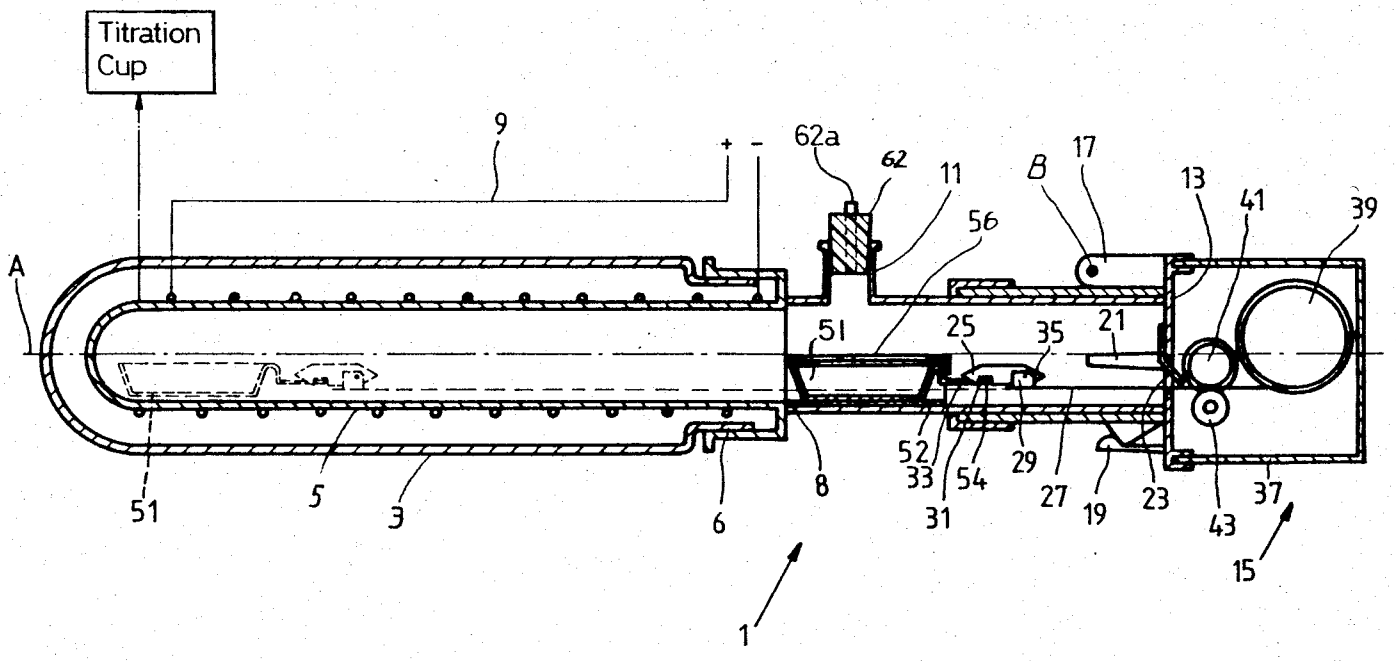
FIG. 1 is a longitudinal sectional view of the drying oven illustrating the housing closure means in its closed position.
Figure 2:
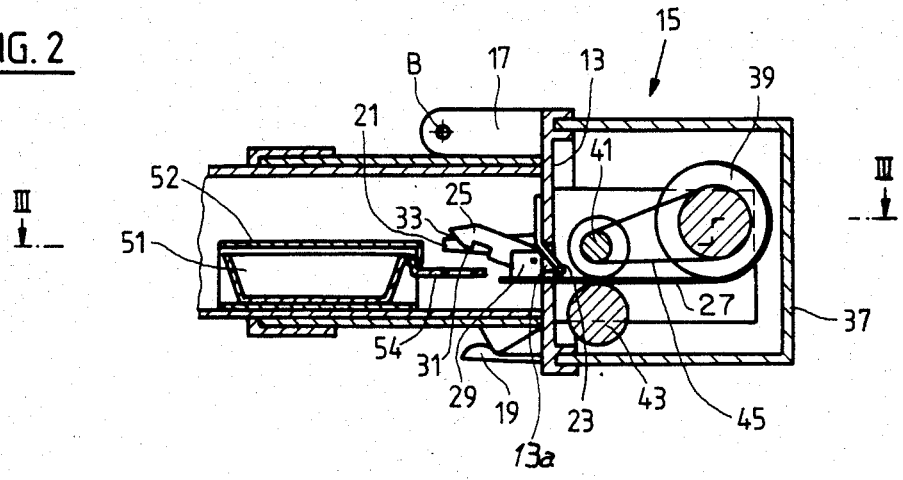
FIG. 2 is a detailed sectional view of the shuttle transporting and latching means of FIG. 1.

Referring first, more particularly to FIGS. 1 and 2, the drying oven 1 includes a hollow oven body 3 into which is introduced the closed end of a drying conduit 5. Helical heating wire 9 is wound concentrically about the drying conduit 5, which heating wire has terminals connected with the positive and negative poles, respectively, of a direct current voltage source. Remote from the oven body 3, an intermediate portion of the drying conduit 5 contains a lateral wall access opening 11 that is normally closed by plug 62, and the free end of the drying conduit is hermetically sealed by one wall 13 of a hollow closure housing 15. The housing 15 is connected by lever 17 for pivotal movement relative to the drying conduit about fixed pivot axis B. The housing 15 is normally latched in the illustrated closed position by a releasable first latch means 19.

Mounted on wall 13 of closure housing means 15 and shifted laterally with respect to the longitudinal axis A of the drying conduit 5 is a spacer stop device 21 adapted to engage the open-ended cover member 52 which receives a shuttle member 51, as will be described below. Also mounted on housing wall 13 adjacent an opening 13*a* (FIG. 2) contained therein is a cam member 23 that is adapted for engagement by a corresponding chamfered surface 35 on the adjacent end of a second latch member 25 that is pivotally connected with a support 29 that is fastened to the free end of a steel band 27. The latch member 25, which is normally in the horizontal position shown in solid lines in FIG. 1, includes at its end remote from the closure housing 15 a hook portion 31 the lower surface of which is chamfered to define chamfer surface 33. The hook 31 is adapted to releasably engage a loop 54 carried by one end of the shuttle device 51.

Figure 3:
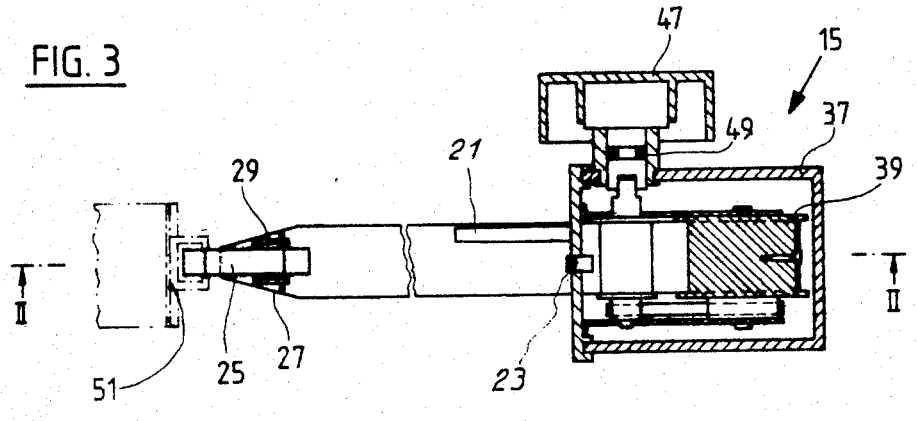
FIG. 3 is a sectional view taken along line III—III of FIG. 2.
Figure 4:
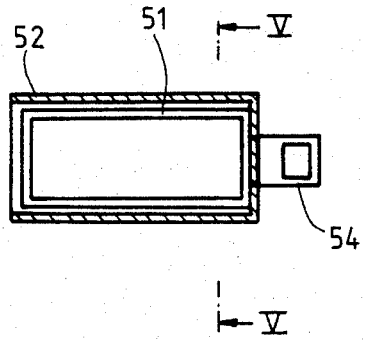
FIG. 4 is a detailed longitudinal view of the shuttle means taken along line IV—IV of FIG. 5.
Figure 5:
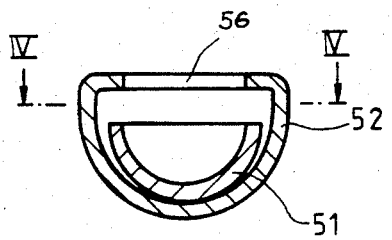
FIG. 5 is a sectional view taken along line V—V of FIG. 4.

The steel band 27 extends through opening 13*a* in housing wall 13 and is fastened to the peripheral surface of a main disk 39 that is rotatably mounted within the housing 15. The band is guided from rotary main disk 39 to the wall opening 13*a* by upper and lower guide rollers 41 and 43. Roller 41 and main disk 39 are connected via suitable drive coupling means, such as drive belt 45. In accordance with an important feature of the invention, the disk 39 and/or rollers 41 and 43 are driven manually externally of the housing 15 by an operating knob 47 which, in the illustrated embodiment, is coupled with the guide pulley 41 via coupling means provided with an O-ring seal 49 (FIG. 3)

As shown in FIG. 2, when the latch device 25 is withdrawn toward the housing closure wall 13 by appropriate rotation of main disk 39 and attendant winding of steel band 27 thereon, the chamfered surface 35 on the latch member 25 engages the stationary cam 23, thereby to pivot the latch member 25 upwardly to the disengaged position shown in FIG. 2, whereby the latch 25 is disconnected from the loop portion 54 of the shuttle member 51. The shuttle member 51, which is adpated to receive the material—such as grain—that is to be dried, is received by a slide cover 52 in the form of a double open-ended tube when the shuttle is outside of the oven body 3. The shuttle 51 is provided at its forward end with a horizontal loop 54 that projects such a distance that the shuttle can be engaged by and released from the latch member 25, respectively. In order to permit loading of the shuttle 51 with the goods to be dried via the filling neck 11, the upper surface of the slide cover 52 is provided with an opening 56 which lies directly beneath the filling neck when the shuttle is retracted from its fully inserted position in the oven (shown in phantom FIG. 1) to its intermediate loading position shown by the solid lines in FIG. 1.

In order to withdraw the moisture produced by the drying of the material in the shuttle 51, the drying conduit 5 is provided in a conventional way with a connection to a conduit the other end of which may be connected with a titration cup. For loading of the shuttle outside the conduit 5, the slide cover 52 need not be provided with an upper opening 56. The filling neck 11 is closed by the stopper or plug 62. The plug or stopper 62 contains a through passage adapted for connection with a tube for supplying scavenging air into the drying conduit. The plug may also include a pierceable membrane 62*a* through which, in the case of necessity, a liquid may be dripped into the shuttle 51 via a suitable injection needle or the like.

The operation of the described apparatus is as follows:

Assume that the steel band 27 has been wound upon main disk 39 to displace to the right the latch member 25, shuttle 51 and cover member 52, whereupon the chamfered surface 35 of the latch member engages the stationary cam 23 to pivot latch member 25 upwardly to its disengaged position relative to the shuttle 51.

Spacer stop member 21 limits the right hand extent of travel of the shuttle cover member 52. Upon release of latch 19, the housing 15 is pivoted upwardly to afford access to the free end of the drying conduit 5, whereupon the shuttle member 51 (and normally the slide cover 52) may be withdrawn for discharge of the dried material therefrom. When new material to be dried is introduced into shuttle 51, the shuttle is again inserted within the open right-hand end of the drying conduit 5, whereupon the closure housing 15 is pivoted downwardly about pivot axis B to its illustrated closed position, thereby hermetically sealing the right hand end of the drying conduit 5. During this downward pivotal movement of the closure housing 15, stop projection 21 engages the cover member 52 to shift to the left within drying conduit 5 the shuttle and cover members 51 and 52 to a given position spaced from wall 13. Simultaneously the chamfered surface 33 on the latch member 25 engages the corresponding edge of the loop 54 which projects from the shuttle 51, whereupon the latch means 25 is initially pivoted upwardly to clear the loop and then downwardly into locked engagement between the hook 31 and the loop 54 as shown in FIG. 2. The housing closure 15 is then locked in its hermetically sealed closed position by the cooperation between latch 19 and the corresponding keeper on the undersurface of the drying conduit 5. Knob 47 is rotated in the counterclockwise direction—as viewed from the rear in FIGS. 2 and 3—to shift the shuttle means 51 and 52 to the left toward the fully inserted position of FIG. 1 (as shown in phantom).

After the drying process has been completed, knob 47 is turned in the clockwise direction—as viewed from the rear in FIGS. 2 and 3—until the shuttle 51 has been withdrawn to its spaced position adjacent the housing wall 13, and when chamfered surface 35 engages the stationary cam 23, the latch 25 is pivoted upwardly toward its disengaged position relative to shuttle 51.

In order to permit the loading of the shuttle 51 from above via the filler opening 11, the shuttle 51 with the slide cover 52 will first be advanced from the fully retracted position of FIG. 2 to the intermediate loading position of FIG. 1 (at which time the cover 52 engages shoulder 8 of the drying conduit), whereupon the shuttle can be loaded through the opening 56. The drying is effected subsequently upon insertion of the shuttle 51 into the portion of drying conduit 5 contained within the hollow oven body 3. Owing to the provision of the shoulder 8, the shuttle is inserted into the oven body 5 without the slide cover 52. Consequently, the slide cover 52 serves as a heat shield about the shuttle 51 when it is between its intermediate (FIG. 1) and fully retracted (FIG. 2) positions.

While preferred forms and embodiments of the invention have been illustrated and described, it is apparent that other changes may be made without deviating from the invention set forth above.

What is claimed is:

1. Drying oven means for drying a quantity of material, comprising (a) a drying oven (1) including a hollow oven body (3), and a drying conduit (5) one end of which is closed and extends within said oven body, the other end of said drying conduit extending outwardly from said oven body and being open;

(b) shuttle means (51) adapted for insertion within said conduit, said shuttle means being adapted to receive said quantity of material;

(c) housing means (15) for closing said other conduit end in a hermetically sealed manner;

(d) transporting means (39) at least partially mounted in said housing means and including a flexible member (27) for displacing said shuttle means longitudinally in said conduit; and (e) means (47) arranged external of said housing for operating said shuttle transporting means.

2. Apparatus as defined in claim 1, wherein said transporting means comprises a main disk (39) mounted for rotation within said housing means, said flexible member (27) being at least partially wound at one end on said main disk, the other end of said flexible member extending within said conduit for connection with said shuttle means, said housing means comprising a hollow cover member.

3. Apparatus as defined in claim 2, wherein said shuttle transporting means further includes a pair of guide disks (41, 43) arranged on opposite sides of said flexible member for guiding the same toward said drying conduit.

4. Apparatus as defined in claim 3, and further including drive means (45) connecting at least one of said guide disks with said main disk.

5. Apparatus as defined in claim 2 wherein said flexible member comprises a steel band fastened at one end to the periphery of said main disk.

6. Apparatus as defined in claim 2, and further including coupling means including a latch member (25) for connecting the other end of said band with said shuttle means.

7. Apparatus as defined in claim 1, wherein said latch member includes chamfered surfaces (33, 35) at each end adjacent said shuttle means and said closure housing means, respectively.

8. Apparatus as defined in claim 7. wherein said closure housing means includes an end wall (13) adapted to abut in hermetically sealed relation the said other end of said drying conduit, said end wall containing an opening (13*a*) through which said band extends;

and further including cam means (23) mounted on said housing end wall for engagement by the corresponding chamfered surface (35) of said latch member for pivoting the same to a released position relative to said shuttle member.

9. Apparatus as defined in claim 1, and further including means (17) connecting said housing means (15) for pivotal movement between open and closed positions relative to said drying conduit means, said housing means comprising a hollow cover member.

10. Drying oven means for drying a quantity of material, comprising (a) a drying oven (1) including a hollow oven body (3), and a drying conduit (5) one end of which is closed and extends within said oven body, the other end of said drying conduit extending outwardly from said oven body and being open;

(b) shuttle means (51) adapted for insertion within said conduit, said shuttle means being adapted to receive said quantity of material;

(c) housing means (15) for closing said other conduit end in a hermetically sealed manner;

(d) transporting means (39) at least partially mounted in said housing means for displacing said shuttle means longitudinally in said conduit;

(e) means (47) arranged external of said housing for operating said shuttle transporting means; and (f) means (17) connecting said housing means (15) for pivotal movement between open and closed positions relative to said drying conduit means;

(g) said shuttle means including a hollow protective slide cover (52) open at least at the end adjacent said housing closure means, and a shuttle member (51) mounted within said slide cover, and further including stop means (21) mounted on said closure housing end wall and extending longtudinally within said drying conduit for engagement with said slide cover to position said shuttle means in a first position spaced a given distance from said housing end wall when said housing means is pivoted from the open position to the closed position, said latch member including a chamfered surface (33) remote from said housing end wall operable to effect automatic latching of said latch member with a corresponding keeper loop (54) on said shuttle member during pivotal movement of said cover member toward its closed position.

11. Apparatus as defined in claim 17, wherein an intermediate portion of said drying conduit (5) outside the oven body contains adjacent said housing means a closable filling neck (11) for loading the shuttle with the material to be dried.

12. Apparatus as defined in claim 11, and further wherein said slide cover (52) contains an opening (56) through which the material to be dried can be introduced when said shuttle and said slide cover are in the loading position beneath said filling neck.

13. Apparatus as defined in claim 11, and further including a plug (62) for closing said filling neck, said plug containing a through passage closed by a pierceable membrane (**62*a***).

14. Apparatus as defined in claim 10, wherein said slide cover is open at each end, and further wherein said drying conduit includes shoulder means (8) adjacent the open end of said oven body for preventing said slide cover from entering said oven body.

15. Drying oven means for drying a quantity of material, comprising (a) a drying oven (1) including a hollow oven body (3), and a drying conduit (5) one end of which is closed and extends within said oven body, the other end of said drying conduit extending outwardly from said oven body and being open;

(b) shuttle means (51) adapted for insertion within said conduit, said shuttle means being adapted to receive said quantity of material;

(c) housing means (15) for closing said other conduit end in a hermetically sealed manner;

(d) transporting means (39) at least partially mounted in said housing means for displacing said shuttle means longitudinally in said conduit, said shuttle transporting means including a main disk (39) mounted for rotation within said housing means, and a flexible member (27) at least partially wound at one end on said main disk, the other end of said flexible member extending within said conduit for connection with said shuttle means;

(e) coupling means for connecting said other end of said flexible member with said shuttle means, said coupling means including a latch member (25) pivotally connected with said flexible member other end and including a hook-shaped portion (31) adapted for connection with said shuttle means; and (f) means arranged externally of said housing for operating said shuttle transporting means.

* * * * *